US006609348B2

(12) United States Patent
Desai

(10) Patent No.: US 6,609,348 B2
(45) **Date of Patent: *Aug. 26, 2003**

(54) METHOD FOR ASSEMBLING A REPEATING SERIES OF TILES

(75) Inventor: Peter Desai, Cartersville, GA (US)

(73) Assignee: Mannington Carpets, Inc., Calhoun, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/140,300

(22) Filed: May 8, 2002

(65) Prior Publication Data

US 2002/0124513 A1 Sep. 12, 2002

Related U.S. Application Data

(62) Division of application No. 09/666,103, filed on Sep. 20, 2000, now Pat. No. 6,397,544, which is a division of application No. 08/957,628, filed on Oct. 24, 1997, now Pat. No. 6,197,400.

(51) Int. Cl.[7] ..... E04B 1/34

(52) U.S. Cl. ..... 52/747.11; 52/384; 52/387; 52/390; 52/392; 52/506.01; 428/33; 428/53; 428/54; 428/88

(58) Field of Search ..... 52/747.11, 384, 52/506.01, 387, 390, 392, 749.11; 428/88, 44, 33, 53, 54, 58

(56) References Cited

U.S. PATENT DOCUMENTS

| | | | |
|---|---|---|---|
| 708,470 | A | 9/1902 | Flood |
| 1,158,051 | A | 10/1915 | Hopkins |
| 3,541,243 | A | 11/1970 | Whitsel |
| 3,621,743 | A | 11/1971 | Feighery et al. |
| 3,654,051 | A | 4/1972 | Bieler |
| 3,665,617 | A | 5/1972 | Gilbert |
| 3,818,790 | A | 6/1974 | Culp et al. |
| 3,857,749 | A | 12/1974 | Yoshida |
| 3,969,851 | A | 7/1976 | Whitacre |
| 4,172,168 | A | 10/1979 | Klaffke et al. |
| 4,287,693 | A | 9/1981 | Collette |
| 4,571,353 | A | 2/1986 | Gable, Jr. |
| 4,620,998 | A | 11/1986 | Lalvani |

(List continued on next page.)

FOREIGN PATENT DOCUMENTS

| | | | | |
|---|---|---|---|---|
| CH | 562379 | * | 5/1975 | ..... 52/387 |
| FR | 2581586 | * | 5/1985 | ..... 52/506.01 |
| JP | 154040 | * | 8/1985 | |
| JP | 77540 | * | 3/1989 | ..... 428/88 |
| JP | 205109 | * | 8/1998 | ..... 428/33 |
| JP | 240227 | * | 8/2002 | ..... 428/33 |

OTHER PUBLICATIONS

Undated Brochure Titled "Ultrasonic Cutting and Routing Technology," and Reference List Item 37 from American GFM.

*Primary Examiner*—Lanna Mai
*Assistant Examiner*—Phi Dieu Tran A
(74) *Attorney, Agent, or Firm*—Finnegan, Henderson, Farabow, Garrett & Dunner LLP

(57) ABSTRACT

A repeating series of tiles has at least three tiles in a series. Each tile within the series has at least two sides capable of interfacing with adjacent tiles within the series. Each of the two sides of each tile within the series has a different shape in the pile direction than the other tiles within the series such that the last tile within the series is capable of interfacing with the first tile of the next series. Further, each tile within the series has at least one side capable of interfacing with at least one tile within another series in order to have adjoining rows of series of tiles. The present invention further includes both a method for producing and assembling a repeating series of tiles.

27 Claims, 4 Drawing Sheets

U.S. PATENT DOCUMENTS

| | | | |
|---|---|---|---|
| 4,731,140 | A | 3/1988 | Yontrarak |
| 4,905,159 | A | 2/1990 | Loriot |
| 4,961,149 | A | 10/1990 | Schneider et al. |
| 5,052,158 | A | 10/1991 | D'Luzansky |
| 5,216,614 | A | 6/1993 | Kuchta et al. |
| 5,324,562 | A | 6/1994 | Mullinax et al. |
| 5,330,806 | A | 7/1994 | Bythewood et al. |
| 5,333,111 | A | 7/1994 | Chaiken et al. |
| 5,447,004 | A | 9/1995 | Vrnak |
| 5,922,157 | A | 7/1999 | Snider |
| 6,112,680 | A | 9/2000 | Hummer |

* cited by examiner

METHOD FOR ASSEMBLING A REPEATING SERIES OF TILES

This is a division of application Ser. No. 09/666,103, filed Sep. 20, 2000, now U.S. Pat. No. 6,397,544, which is a division of application Ser. No. 08/957,628, filed Oct. 24, 1997, now U.S. Pat. No. 6,197,400, both of which are incorporated herein by reference.

BACKGROUND OF THE INVENTION

This invention relates generally to flooring segments, which are preferably carpet tiles and, more particularly, to a series of carpet tiles having adjacent surfaces of varying configurations suitable for forming a repeating series of tiles.

Modular carpet tiles are utilized in both household and commercial settings to provide an efficient and cost-effective manner for covering floor surfaces of differing dimensions. As can be seen in FIG. 1, known modular carpet tiles are uniform in shape, and are placed on a surface by abutting the tiles next to each other. Commercial interest in modular carpet tiles is due in part to the advantages of being more readily removed and replaced than traditional floor coverings, and providing relatively simple access to sub-floor space, which makes wiring, cables, plumbing, and the like readily accessible. Because of these advantages over more traditional floor coverings, such tiles are in popular demand.

The use of modular carpet tiles, however, is restrained in several respects. For example, consumers require the installed tiles to have a monolithic look. Consumers expect the finished product to have a seamless, uniform appearance similar to broadloom carpet. Further, an individual installing tiles with a face pattern must carefully orient the tiles to avoid a zippering effect otherwise caused by having offset or overlapping design patterns.

Additionally, modular carpet tiles typically have solid colors or random face patterns in order to facilitate the process of installation by permitting any one tile to be placed next to tile any other. As such, a large number of good carpet styles with non-random patterns made by tufted, woven, knitted, or print processes are excluded from the carpet tile market.

There are further problems known to the art. Generally, modular carpets are cut into square configurations (approximately 18"×18" in size) by utilizing a straight-line die cutting press. In the cutting process, a predetermined length of the carpet (usually three feet for 18"×18" tiles) is advanced onto the press from a roll of 74" wide carpet. Due to the imprecision in most advancement mechanisms, the carpet must be maneuvered slightly more than the predetermined length in order to extend material over the front of the cutting line. Consequently, each cutting stroke of the press typically results in excess carpet waste. Further, the straight-line cutting technique often creates, in the cross direction, frayed edges known as the "trailing edge" effect. Moreover, there is no flexibility in the cutting line in that a given die press is fixed for a set dimension. When a change in the tile size is required, the die must be removed and replaced with a new die of differing cutting dimensions, resulting in significantly higher costs and time for the cutting process.

Accordingly, there developed a need for a non-wasteful and efficient method for producing modular carpet tiles of varying dimensions that would allow the use of non-random face patterns and alternative carpet material. Further, there developed a need for carpet tiles that did not result in visible seams after installation, but allowed for more easily installed carpet tiles both with or without non-random face patterns.

SUMMARY OF THE INVENTION

In view of the foregoing considerations and problems known in the art, repeating series of tiles in accordance with one embodiment of the present invention comprises at least three tiles in a series, each tile within the series having at least two sides capable of interfacing with adjacent tiles within the series, each of the two sides of each tile within the series having a different shape in the pile direction than the other tiles within the series such that the last tile within the series is capable of interfacing with the first tile of the next series. Further, each tile within the series preferably has at least one side capable of interfacing with at least one tile within another series to adjoin rows of series of tiles.

In a further aspect of the invention, a method for producing a repeating series of tiles is disclosed comprising the steps of providing tile material, and cutting the tile material into at least three tiles in a series, whereby each tile within the series has at least two sides capable of interfacing with adjacent tiles within the series, each of the two sides of each tile within the series has a different shape in the pile direction than the other tiles within the series such that the last tile within the series is capable of interfacing with the first tile of the next series. The method for producing a repeating series of tiles preferably further includes the substep of cutting each tile within the series such that it has at least one side capable of interfacing with at least one tile within another series to adjoin rows of series of tiles.

In a further aspect of the invention, a method for assembling a repeating series of tiles is disclosed comprising the steps of providing at least three tiles in a series, whereby each tile within the series has at least two sides capable of interfacing with adjacent tiles within the series, each of the two sides of each tile within the series having a different shape in the pile direction than the other tiles within the series such that the last tile within the series is capable of interfacing with a first tile of a next series. Further, the method includes placing each tile in the series on a floor surface adjacent to and in contact with the next tile in the series, and further placing the first tile of the next series on the surface adjacent to and in contact with the last tile of the previous series, and continuing to place tiles within each successive series on the floor surface to form a repeating series of tiles. The method for assembling a repeating series of tiles preferably further includes providing each tile within the series at least one side capable of interfacing with at least one tile within another series to adjoin rows of series of tiles, and placing each tile within the series adjacent to and in contact with a tile within another series to create adjoining rows of series of tiles.

Other aspects and advantages of the invention will be set forth in part in the description which follows, and in part will be apparent from the description, or may be learned by practice of the invention.

BRIEF DESCRIPTION OF THE DRAWINGS

The accompanying drawings, which are incorporated in and constitute part of the specification, illustrate preferred embodiments of the invention and, together with a description, serve to explain the principles of the invention.

In the drawings.

DETAILED DESCRIPTION OF THE PREFERRED EMBODIMENT

Reference will now be made to the present preferred embodiment of the invention, which is illustrated in the accompanying drawings.

Generally, in accordance with an embodiment of the present invention, the repeating series of tiles comprises at least three tiles in a series, each tile within the series having at least two sides capable of interfacing with adjacent tiles within the series, each of the two sides of each tile within the series having a different shape in the pile direction than the other tiles within the series such that the last tile within the series is capable of interfacing with the first tile of the next series.

Figure 2:
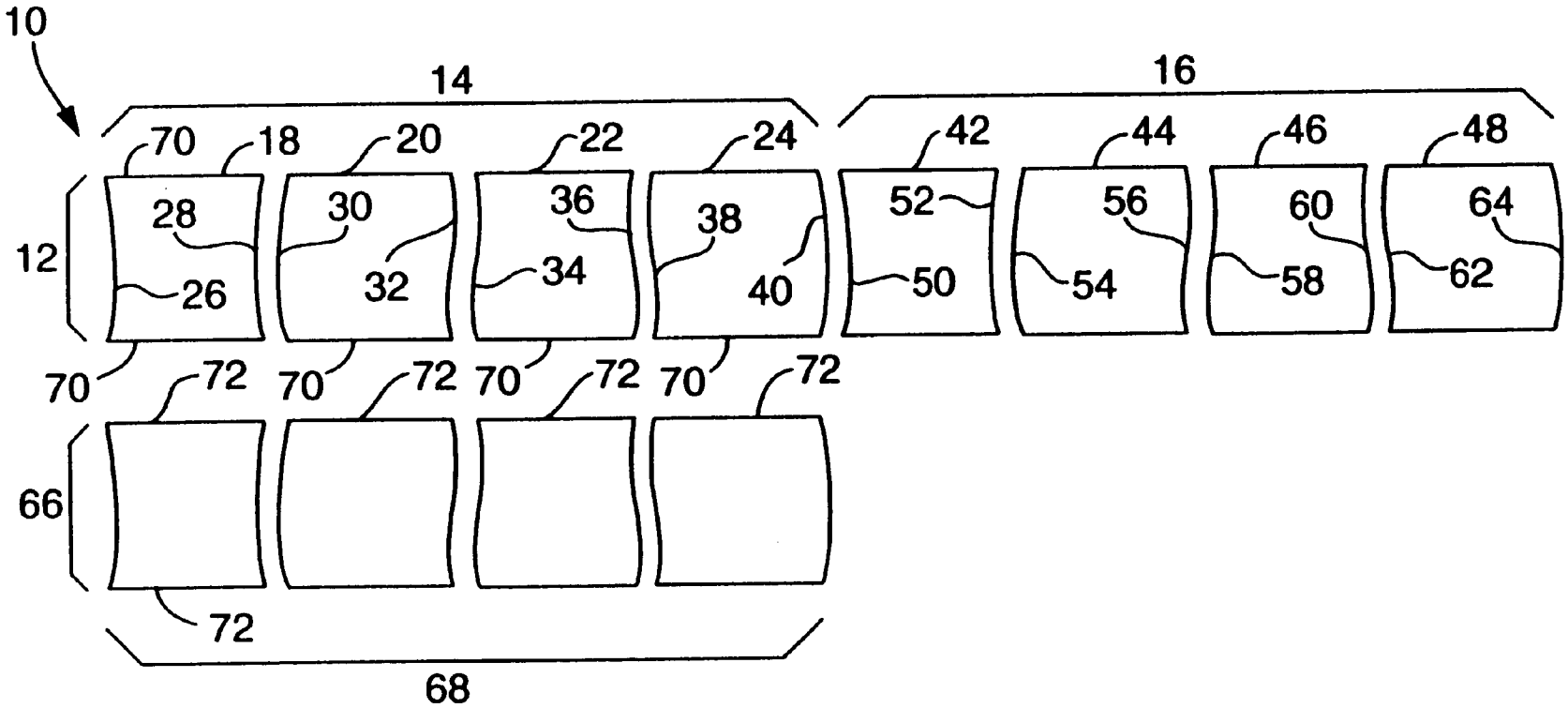
FIG. 2 is a diagrammatic representation of a repeating series of tiles according to one embodiment of the present invention.

As embodied herein and as shown in FIG. 2, a repeating series of tiles, alternatively referred to as a repeating set of panels, is generally depicted by the numeral 10, and is represented as having a multiple series of tiles interconnecting one to another. The repeating series of tiles 10 includes a series 14, which illustrates the base orientation of the tiles. Series 14 should include at least three tiles, whereas here, the series shown has a first or starting tile 18, a second tile 20, a third tile 22, and a fourth or last tile 24. As envisioned, the base series 14 could include a larger number of tiles, but preferably includes at least three in number as is explained later.

Each tile 18, 20, 22, 24 has at least two sides capable of interfacing with adjacent tiles within the series 14 or within an adjacent series. That is, first tile 18 has a side 28 capable of interfacing with a side 30 of second tile 20. Further, second tile 20 has another side 32 capable of interfacing with a side 34 of third tile 22, which has another side 36 capable of interfacing with a side 38 of last tile 24, which has another side 40 capable of interfacing with a side of a first tile of the next series. As shown in FIG. 2, the tiles are not in abutting contact, but are represented as being spaced apart from each other. It should be understood that during installation, the tiles would be placed in physical contact with each other.

The series is repeated by placing a second series 16 adjacent to the first series 14, thereby forming a row 12. As further shown in FIG. 2, the second series 16 is identical in configuration to first series 14 such that the first tile 42 of the second series 16 has a side 50 that is capable of interfacing with the side 40 of the last tile 24 of the first series 14.

In further accordance with the present preferred embodiment of the invention, each tile within the series is generally polygonal and has a different circumferential shape in the pile direction than the other tiles in the same series. Further, each series has the same number of tiles, wherein each tile within a series has the same shape as a corresponding tile in another series of tiles. As embodied herein and with continued reference to FIG. 2, each tile 18, 20, 22, 24 is generally square (although a shape having at least three sides is contemplated within the scope of the claimed invention), the tiles vary from each other in the configuration of their interfacing sides 26, 28, 30, 32, 34, 36, 38, 40. However, the circumferential shape of each tile is such that the interfacing side of one tile has a corresponding tile adjacently located in the series that has an equal and oppositely shaped side. For example, second tile 20 is uniquely shaped within the series 14, and further has the side 30 that is mirror opposite in shape to the side 28 of first tile 18, and the second tile 20 further has the side 2 that is mirror opposite in shape to the side 34 of third tile 22. Additionally, each series 14, 16 has the same number of tiles, and each tile in one series has the same circumferential shape as another tile in another series. For example, first tiles 18, 42 are identical in shape, as are second tiles 20, 44, third tiles 22, 46, and first tiles 24, 48, respectively. Further, it should be understood that the present descriptions are based upon a tile's pile direction, which represent, for example with carpet tiles, the direction that the yarn leans as a result of manufacturing. As with other types of tile materials, the pile direction may be understood to represent an identifiable or pre-marked direction either by marking the underside of the tile with a directional arrow or in another like manner.

By configuring each tile so that it can only interface on either side with a specific tile within the series when the pile is properly oriented, the tiles within each series may be placed on a floor surface in only one correct order. Further, because each series of tiles has the same configuration and the last tile of one series can interface with the first tile of another series, a multiple number of series may be adjoined to create a repeating series of tiles to cover a floor surface. As can be understood by one skilled in the art, by utilizing the same base series, the tiles may be arranged to create a repeating series in order to cover a surface area of a given dimension, which is explained in greater detail later.

In further accordance with a preferred embodiment of the present invention, each tile within the series has at least one side capable of interfacing with at least one tile within another series in order to have adjoining rows of series of tiles. As further embodied herein and with continued reference to FIG. 2, the repeating series of tiles 10 further includes another series of tiles 68 that may be placed adjacent to the first series 14 in order to provide multiple rows of tiles 12,16. That is, each tile in the first series 14 has an additional side 70 capable of interfacing with a side 72 of series 68. As shown in FIG. 2, sides 70, 72 are straight surfaces that would allow tiles from different rows 12, 66 to abut against each other when placed on a floor surface. These straight surfaces permit the placement of any of the tiles within a row against any of the tiles of another row.

Figure 1:
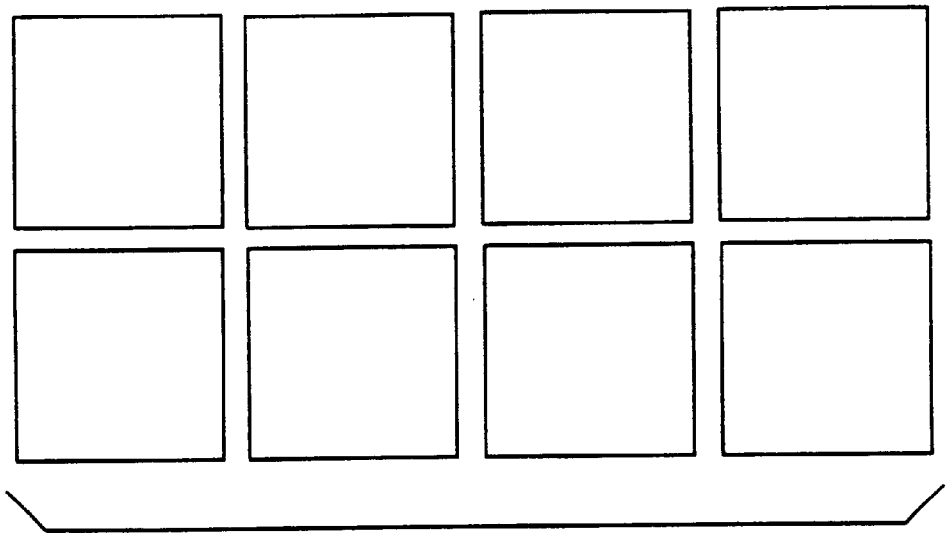
FIG. 1 PRIOR ART
FIG. 1 is a diagrammatic representation of the prior art.
Figure 3:
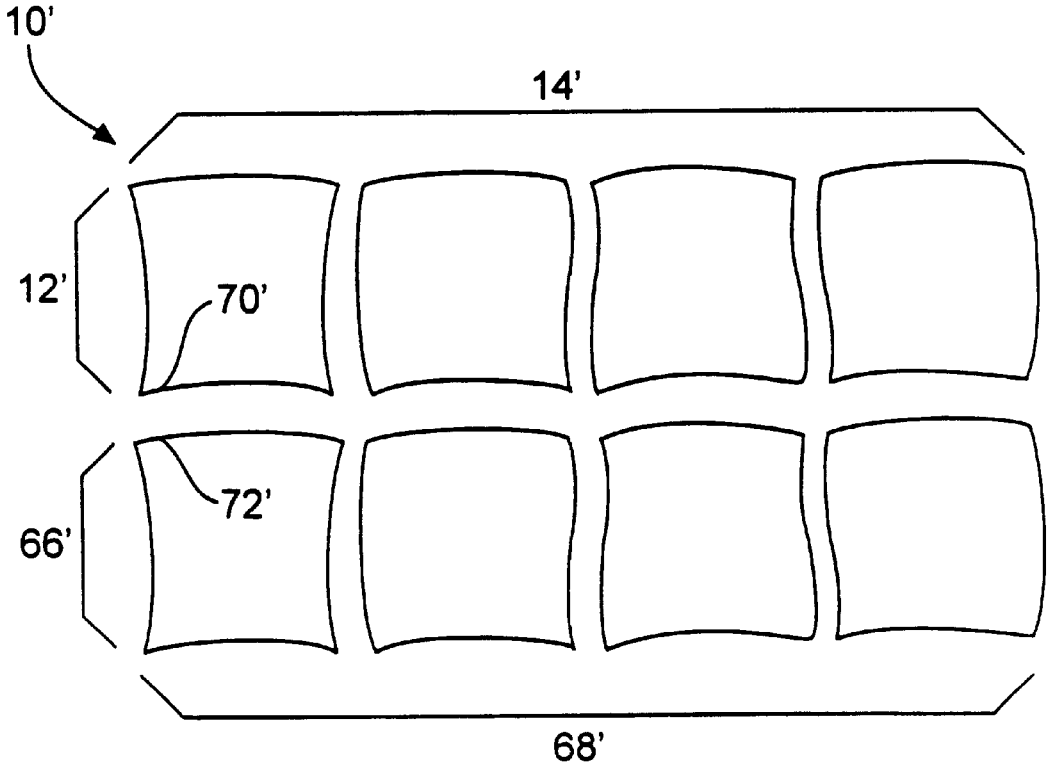
FIG. 3 is another diagrammatic representation of a repeating series of tiles according to another embodiment of the present invention.
Figure 4:
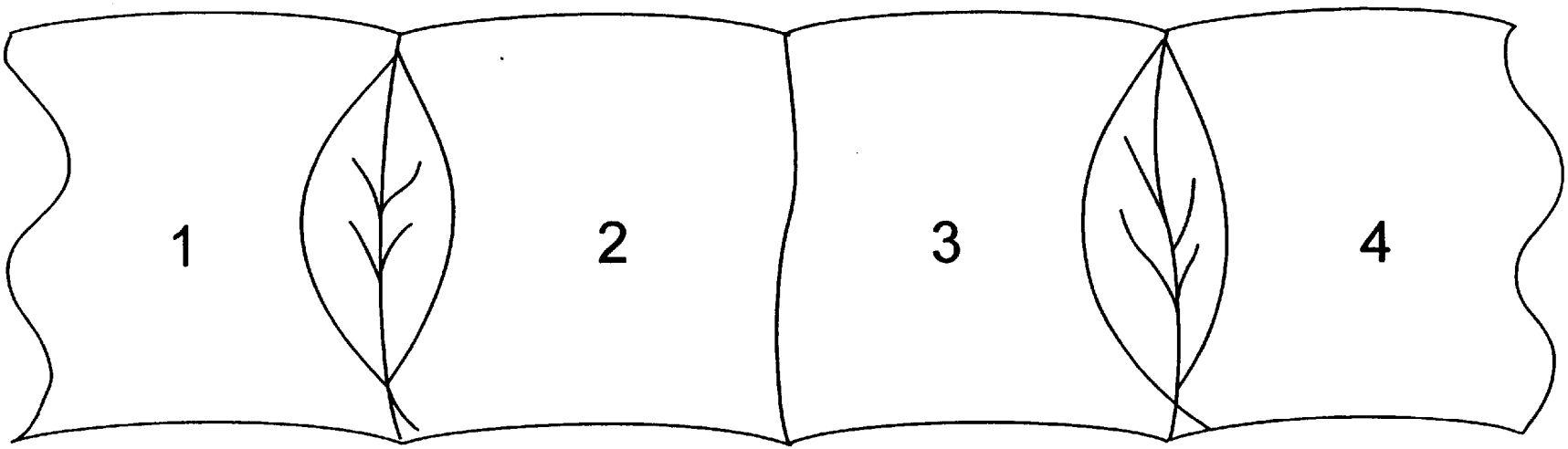
FIG. 4 is another diagrammatic representation of a repeating series of tiles according to another embodiment of the present invention.
Figure 5:
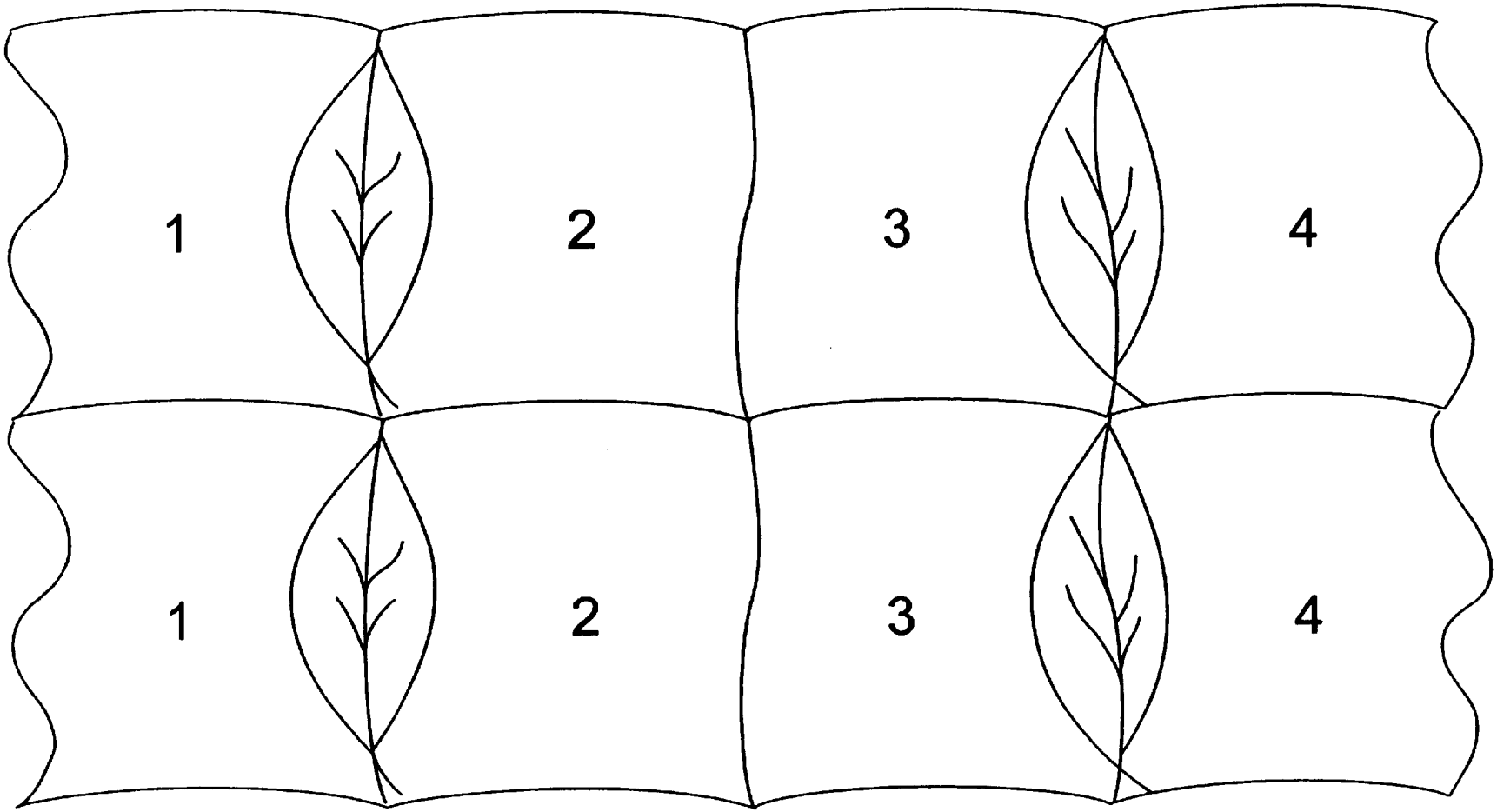
FIG. 5 is another diagrammatic representation of a repeating series of tiles according to another embodiment of the present invention.

An alternative embodiment, as shown in FIG. 3, includes curved surfaces along sides 70', 72' in order to further avoid or minimize the previously discussed problems of zippering. Further still, the illustrated curvatures of sides 70', 72' are only exemplary of the available mating surface designs, and more complex configurations are possible. For example, a given tile's outward configuration in a series can be manufactured so that it will only mate with a specific tile from another series from row to row. Further, by specially configuring the circumferential shapes of the tiles in the manners discussed, the use of complex patterns on the face of the tiles becomes more practical by increasing the reliability that the placement of the tiles on a floor surface will result in the proper orientation of the face pattern, as can be seen in FIGS. 4 and 5.

Producing the Repeating Series of Tiles

Still in accordance with the present invention, a method for producing a repeating series of tiles is disclosed comprising the steps of: providing tile material; and cutting the tile material into at least three tiles in a series, each tile within the series having at least two sides capable of interfacing with adjacent tiles within the series, each of the two sides of each tile within the series having a different shape in the pile direction than the other tiles within the series such that the last tile within the series is capable of interfacing with the first tile of the next series.

As embodied herein, the tile is generally made from tufted, woven, knitted, printed, patterned-needled punched, fusion bonded or similar carpet-type materials. Other tile materials may be utilized, for example, linoleum, stone (such as marble), ceramic, polymer-based materials (such as rubber, vinyl, resilient vinyl), wood, metal, or other like surface covering materials. A carpet-type material, however, is preferred and the tiles are typically cut from about 70–80" wide roll as the roll advances on a cutting press. The carpet is cut into at least three tiles, and preferably four tiles having the shape of the base series 14 or series 14' as shown in FIGS. 2 and 3, with each tile having the approximate dimension of 18"×18" in size. A pneumatically controlled knife (a sharp-edged member) is preferably used to cut the tiles at a high speed. Specifically, the knife is directed to follow the outline of the base series, thereby cutting the individual tiles with single stroke movements. The knife is directed by computer, and the process is repeated to create multiple series of tiles, (e.g., series 14, 16, 68, etc.). By using a knife to cut the material into the shapes depicted in FIGS. 2 and 3, disadvantages of conventional tile cutting systems (die presses) are avoided. The amount of wasted material is reduced, and the mistakes associated with installation are likewise reduced because the tiles can only be installed sequentially by series in order to fit properly on the floor. Further, the necessity of removing and replacing dies presses is obviated by utilizing a tool adapted to cut tiles into a wide ranged of dimensions. Other cutting methods may be employed, for example, high pressure water jets, lasers, burning, etc. in order to produce the desired sequential tile shapes.

Although here, it is described that four tiles are cut from a roll of carpet to produce the shapes of the tiles depicted in FIGS. 2 and 3, any number of tiles may be cut from a roll of material depending on the operator's election on a base series design. The dimensional sizes of the tiles may be reduced to allow for more tiles cut from a roll of material, or the width of the material may be increased to allow for the production of larger tiles from a given cross-section. Further, through this cutting step, the circumferential shape of a preferred tile side may have deviations from a straight line from up to about 6.0" or more depending on the configuration, for example, for tiles having an approximate area of 18"×18" to 36"×36". However, it is understood that a tile may alternatively have a straight side. Also, when a series of tiles are cut in a row, each tile can be cut with a different shape to avoid or minimize zippering or face pattern misalignment at modular seams when installed, in addition to achieving the other advantages that are described and that are apparent.

Assembling the Repeating Series of Tiles

In further accordance with another embodiment of the present invention, a method for assembling a repeating series of tiles is disclosed comprising the steps of: providing a repeating series of tiles having at least three tiles in a series, each tile within the series having at least two sides capable of interfacing with adjacent tiles within the series, each of the two sides of each tile within the series having a different shape in the pile direction than the other tiles within the series such that the last tile within the series is capable of interfacing with a first tile of a next series; and placing each tile in the series on a floor surface adjacent to and in contact with the next tile in the series, and further placing the first tile of the next series on the surface adjacent to and in contact with last tile of the previous series, and continuing to place tiles within each successive series on the floor surface to form a repeating series of tiles.

As embodied herein, the tiles are installed sequentially by each series in order to place them in a proper fit on a floor surface. As can be envisioned from FIG. 2, a series 14 is installed by placing the first tile 18 on the floor surface. A glue or other suitable adherent is used on the underside of each tile to secure it to the surface. The glue or adherent may be of the type that is put on the underside of the tile during the manufacturing process, or of the type that is applied to the floor prior to placement of the tile thereto, or a combination thereof. The second tile 20 is placed in abutting contact adjacent to the first tile 18 such that side 28 and side 30 interface. Likewise, the third tile 22 is placed so that sides 32, 34 interface, and then the last tile is placed so that sides 36, 38 interface. The first tile 42 of the next series 16 is placed adjacent to the last tile 24 of the first series 14. The step is repeated as is required to cover a given surface area. Of course, the successive series of tiles may be placed in interfacing relationships by moving from a starting tile to either the left or right or both. Further, series 68 may be placed adjacent to series 14, and so on, to create a broadloom appearance. In placing the tiles, one skilled in the art would appreciate that the tiles may need to be cut by the use of a hand tool in order to fit pieces next to walls or around columns, etc. The sequential placement of the repeating series of tiles of different shapes avoids or minimizes zippering or face pattern misalignment at modular seams, and provides a relatively easy method for installing floor covering. Additionally, face patterns of complex designs may be recreated by assembling the repeating series.

Further, it should be appreciated that a series can begin with any tile in a series. Although the above descriptions and the drawings depict a given series starting with the first tile, for example tile 18, a given series may begin with any tile in the series and the remaining tiles placed thereafter. That is, for example, second tile 20 may be installed first with tiles 22, 24, 18 following, where tile 18 will then become the last tile installed in the series. As such, the next series would begin with tile 44, and continue with tiles 46, 48, 42, etc. This provides for a simplistic method of installing the tiles in that the installer can begin with any tile in the series and install the remaining tiles accordingly.

It will be apparent to those skilled in the art that modifications and variations can be made in the above-described embodiments of the present invention without departing from the scope or spirit of the invention. Thus, it is intended that the present invention cover such modifications and variations provided they come within the scope of the appended claims and their equivalents.

What is claimed is:

1. A method for assembling a repeating series of tiles comprising the steps of:

providing a first, a second, and a third series of tiles, the first series of tiles having at least three tiles each having a first side configured to interface with a side of an adjacent tile within the first series of tiles and a second side configured to interface with a side of an adjacent tile within the second series of tiles, each of the first and second sides of each tile within the first series of tiles having a different shape than respective sides of the other tiles within the first series of tiles such that a curvilinear side of a last tile within the first series is configured to interface with a complementary side of a first tile of the third series of tiles;

placing each tile in the first series of tiles on a floor surface adjacent to and in contact with each other along a first row, and placing the first tile of the third series of tiles on the surface along the first row such that the complementary side of the first tile of the third series of tiles is adjacent to and in contact with the curvilinear side of the last tile of the first series of tiles; and placing each tile in the second series of tiles on the floor along a second row such that each tile in the second series of tiles is adjacent to and in contact with adjacent tiles of the first series of tiles so as to form a repeating series of tiles.

2. The method of claim 1, wherein placing each tile in the second series of tiles on the floor includes forming adjoining rows of series of tiles.

3. The method of claim 1, wherein each of the placing steps orient the tiles to provide a face pattern with each of the series of tiles.

4. The method of claim 1, wherein the placing steps orient each series of tiles relative to each other so as to form a series of face patterns.

5. The method of claim 1, wherein the placing steps orient each series of tiles relative to each other so as to form a uniform face pattern.

6. The method of claim 1, wherein providing the first, second, and third series of tiles comprises forming individual face patterns on each of the tiles within the first, second, and third series of tiles so as to form a uniform design when each of the tiles is placed together.

7. The method of claim 1, providing the first, second, and third series of tiles comprises shaping each of the tiles so that they can be adjoined together only in a predetermined sequential order.

8. The method of claim 7, wherein the placing steps include sequentially placing each of the tiles within the first, second, and third series of tiles along a first direction in accordance with a predetermined shape of each of the tiles.

9. The method of claim 1, further comprising providing a fourth series of tiles, and sequentially placing each tile within the fourth series of tiles on the floor along the second row such that a complementary side of the first tile within the fourth series of tile is adjacent to and in contact with a curvilinear side of a last tile within the second series of tiles.

10. A method for assembling a repeating series of tiles, comprising:

providing a first, a second, and a third series of tiles each shaped to be assembled in only a predetermined sequential order, the first series of tiles including at least three tiles; and sequentially placing each of the tiles within the first, second, and third series of tiles together on a surface in accordance with the predetermined sequential order such that a first side of each of the tiles within the first series of tiles interfaces with a side of an adjacent tile within the first series of tiles, a second side of each of the tiles within the first series of tiles interfaces with a side of an adjacent tile within the second series of tiles, and a curvilinear side of a last tile within the first series of tiles interfaces with a complementary side of a first tile within the third series of tiles.

11. The method of claim 10, wherein providing the first, second, and third series of tiles comprises forming at least three tiles within the second and third series of tiles.

12. The method of claim 10, wherein providing the first series of tiles comprises shaping each tile within the first series of tiles differently relative to each other so that each of the tiles within the first series of tiles can be assembled in only the predetermined sequential order along a row.

13. The method of claim 10, wherein providing the second series of tiles comprises shaping each tile within the second series of tiles differently relative to each other so that each of the tiles within the second series of tiles can be assembled in only the predetermined sequential order along a row.

14. The method of claim 10, wherein providing the third series of tiles comprises shaping each tile within the third series of tiles differently relative to each other so that each of the tiles within the third series of tiles can be assembled in only the predetermined sequential order along a row.

15. The method of claim 10, wherein providing the first, second, and third series of tiles comprises forming an individual face pattern on each of the tiles so as to form a uniform design when each of the tiles is placed together.

16. The method of claim 10, wherein sequentially placing each of the tiles within the first, second, and third series of tiles together on a surface in accordance with the predetermined sequential order comprises:

placing a first tile within the first series of tiles on the surface before placing a second tile within the first series of tiles on the surface;

placing a second tile within the first series of tiles before placing the last tile within the first series of tiles on the surface; and placing the last tile within the first series of tiles on the surface before placing the first tile within the third series of tiles on the surface.

17. The method of claim 16, wherein sequentially placing each of the tiles within the first, second, and third series of tiles together on a surface in accordance with the predetermined sequential order further comprises:

placing a first tile within the second series of tiles on the surface before placing a second tile within the second series of tiles on the surface;

placing a second tile within the second series of tiles before placing the last tile within the second series of tiles on the surface; and placing the last tile within the second series of tiles on the surface before placing a first tile within a fourth series of tiles on the surface.

18. The method of claim 10, further comprising providing a fourth series of tiles, and sequentially placing each tile within the fourth series of tiles on the floor along the second row such that a complementary side of the first tile within the fourth series of tile is adjacent to and in contact with a curvilinear side of a last tile within the second series of tiles.

19. A method for assembling a repeating set of panels, comprising:

providing a first, a second, and a third set of panels each shaped to be assembled in only a predetermined sequential order, the first set of panels including at least three panels; and sequentially placing each of the panels within the first, second, and third set of panels together on a surface based on the predetermined sequential order such that a first side of each of the panels within the first set of panels interfaces with a side of an adjacent panel within the first set of panels, a second side of each of the panels within the first set of panels interfaces with a side of an adjacent panel within the second set of panels, and a curvilinear side of a last panel within the first set of panels interfaces with a complementary side of a first panel within the third set of panels.

20. The method of claim 19, wherein providing the first, second, and third set of panels comprises forming at least three panels within the second and third set of panels.

21. The method of claim 19, wherein providing the first set of panels comprises shaping each panel within the first set of panels differently relative to each other such that each of the panels within the first set of panels can be assembled in only the predetermined sequential order along a row.

22. The method of claim 19, wherein providing the second set of panels comprises shaping each panel within the second set of panels differently relative to each other so that each of the panels within the second set of panels can be assembled in only the predetermined sequential order along a row.

23. The method of claim 19, wherein providing the third set of panels comprises shaping each panel within the third set of panels differently relative to each other so that each of the panels within the third set of panels can be assembled in only the predetermined sequential order along a row.

24. The method of claim 19, providing the first, second, and third set of panels comprises forming an individual face pattern on each of the panels so as to form a uniform design when each of the panels is placed together.

25. The method of claim 19, wherein sequentially placing each of the panels within the first, second, and third set of panels together on a surface based on the predetermined sequential order comprises:

placing a first panel within the first set of panels on the surface before placing a second panel within the first set of panels on the surface;

placing a second panel within the first set of panels before placing the last panel within the first set of panels on the surface; and placing the last panel within the first set of panels on the surface before placing the panel within the third set of panels on the surface.

26. The method of claim 25, wherein sequentially placing each of the panels within the first, second, and third set of panels together on a surface based on the predetermined sequential order further comprises:

placing a first panel within the second set of panels on the surface before placing a second panel within the second set of panels on the surface;

placing a second panel within the second set of panels before placing the last panel within the second set of panels on the surface; and placing the last panel within the second set of panels on the surface before placing a first panel within a fourth set of panels on the surface.

27. The method of claim 19, further comprising providing a fourth set of panels, and sequentially placing each panel within the fourth set of panels on the floor along the second row such that a complementary side of the first panel within the fourth set of panels is adjacent to and in contact with a curvilinear side of a last panel within the second set of panels.

* * * * *

UNITED STATES PATENT AND TRADEMARK OFFICE

CERTIFICATE OF CORRECTION

PATENT NO. : 6,609,348 B2
DATED : August 26, 2003
INVENTOR(S) : Peter Desai

It is certified that error appears in the above-identified patent and that said Letters Patent is hereby corrected as shown below:

Column 7,
Line 32, change “claim 1, providing” to -- claim 1, wherein providing --;

Column 9,
Line 20, change “claim 19, providing” to -- claim 19, wherein providing --;

Column 10,
Line 5, change “the panel” to -- the first panel --.

Signed and Sealed this

Second Day of March, 2004

JON W. DUDAS
*Acting Director of the United States Patent and Trademark Office*